US005649683A

United States Patent [19]

Ahn

[11] Patent Number: 5,649,683

[45] Date of Patent: Jul. 22, 1997

[54] BOOK HOLDER

[76] Inventor: Shang Bum Ahn, 665 MaeKum 2ri, Kumchoneub, Pajukun Kyounggido, Rep. of Korea

[21] Appl. No.: 513,692

[22] Filed: Aug. 11, 1995

[30] Foreign Application Priority Data

Aug. 12, 1994 [KR] Rep. of Korea ..... 94-19921

[51] Int. Cl.[6] ..... A47B 97/04

[52] U.S. Cl. ..... 248/453; 248/455; 248/456

[58] Field of Search ..... 248/453, 455, 248/454, 456, 457, 451, 447, 446, 441.1, 442

[56] References Cited

U.S. PATENT DOCUMENTS 4,043,530 8/1977 May ..... 248/453

4,848,243 7/1989 Giordano ..... 248/455

5,290,003 3/1994 Reyes ..... 248/455

5,492,299 2/1996 Thermos et al. ..... 248/453

*Primary Examiner*—Leslie A. Braun

*Assistant Examiner*—Willie Berry, Jr.

*Attorney, Agent, or Firm*—Blakely Sokaloff Taylor & Zafman

[57] ABSTRACT

A book holder having a memo stand (8) secured to the rear upper side of the contact plate (1) to fix manuscript papers or scratch papers, a supporting rod (7) to control an inclination angle of the contact plate (1), and two retaining elements (9) to grip a book to read.

6 Claims, 3 Drawing Sheets

BOOK HOLDER

BACKGROUND OF THE INVENTION

This invention relates to a book holder and more particularly to a book holder that may control an angle of inclination while gripping a book regardless of the thickness of the book, and may hold scratch papers or manuscript papers so they can be read comfortably.

Generally, a book holder having a "ш", shape as shown in FIG. 5 and FIG. 6 is well known. The conventional book holder comprises a contact plate (11) having cut out portion (11*a*), a book shelf (13) which is shaped corresponding to the cut out portion and may pivot by pin (12), two retaining elements (14) pivotably inserted to corresponding outer sides of the cut out portion (13*a*) which are formed away from each other on a bottom side of the book shelf (13), and a "U", shaped support (16) and recesses (13*b*) which are formed in a line on both upper inner sides of the book shelf to control an angle of inclination.

Accordingly, the book shelf (13) is pushed on to the support (16) so as to contact with a desk. The support (16) is then caught in the recess (13*b*) formed on the back side of the book shelf (13). A retaining element (14), pivotably fixed to the bottom of the book shelf (13), is pivoted forward. A reader may place a book on the book shelf (13) protruded from the contact plate (11) and then re-push the retaining element (14) forward to secure the book.

The conventional book holder described above, however, fails to grip the first or the last pages and moreover, has limited ability to control an inclination angle.

SUMMARY OF THE INVENTION

It is therefore an object of the present invention to provide a book holder that comprises a memo stand for scratch papers. The memo stand is located on an upper side of a contact plate. A supporting rod, and two retaining elements grip the book without regard to the thickness of the book.

To achieve the foregoing object, the present invention comprises a contact plate for supporting a book, a supporting rod of which one end is pivotably secured between the "L" shaped brackets via a bolt, washers and a nut to support the contact plate, a memo stand pivotably secured together with the supporting rod to attach scratch papers, and two retaining elements to grip the book regardless of the respective thicknesses of both opened sides, wherein the brackets are fixed to face each other on the rear middle upper side of the contact place by a screw which supports the contact plate at a desired angle of inclination.

BRIEF DESCRIPTION OF THE DRAWINGS

The above and other objects and advantages of the invention will be apparent upon consideration of the following detailed description, taken in conjunction with the accompanying drawings, in which like reference numbers refer to like parts throughout, and in which.

DETAILED DESCRIPTION OF THE INVENTION

Figure 1:
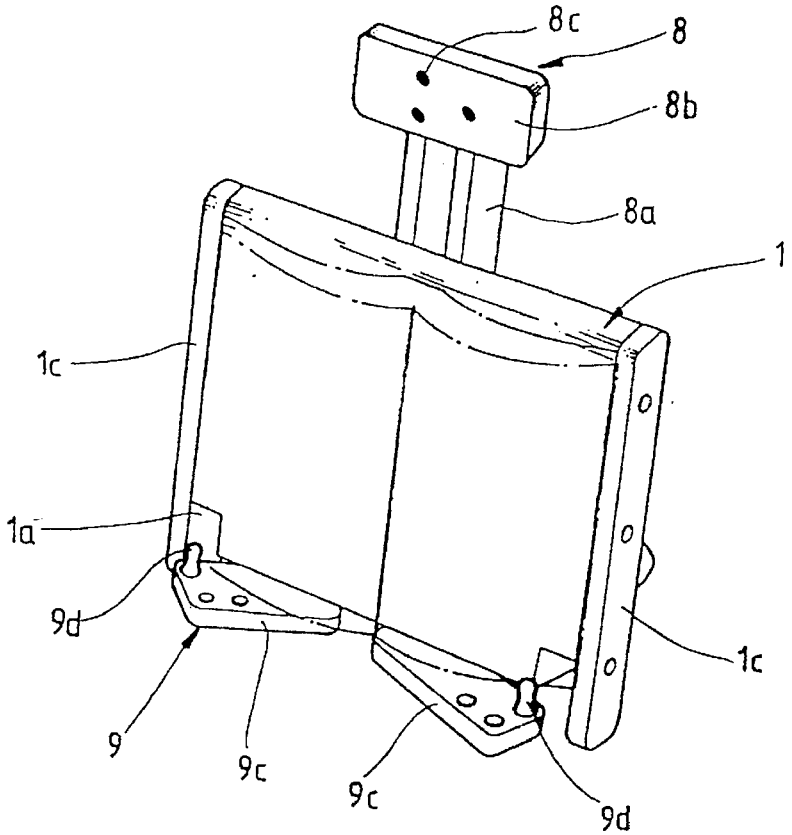
FIG. 1 is a perspective view illustrating the book holder according to the present invention.
Figure 2:
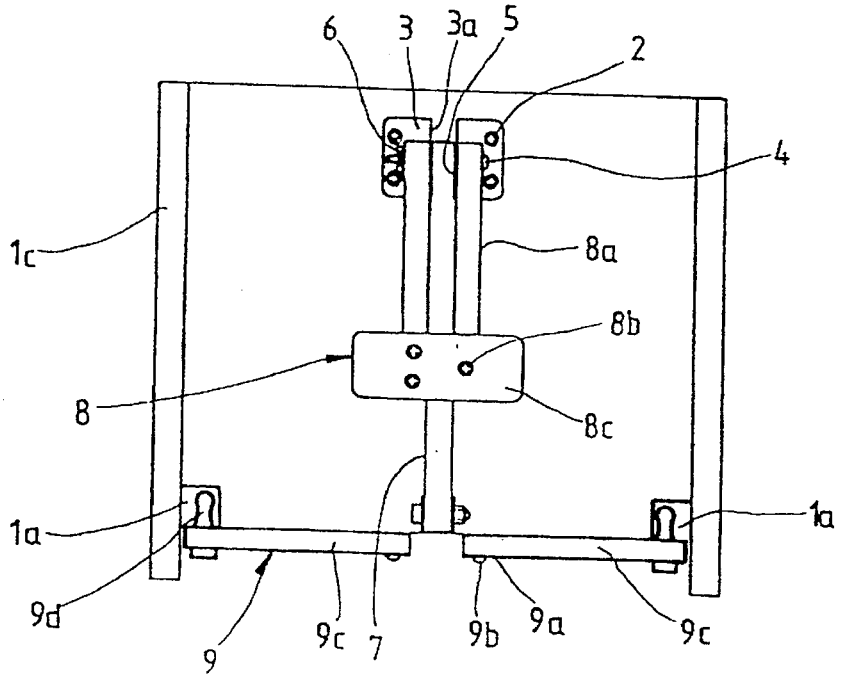
FIG. 2 is a bottom plan view illustrating a collapsed state of the book holder shown in FIG. 1.
Figure 3:
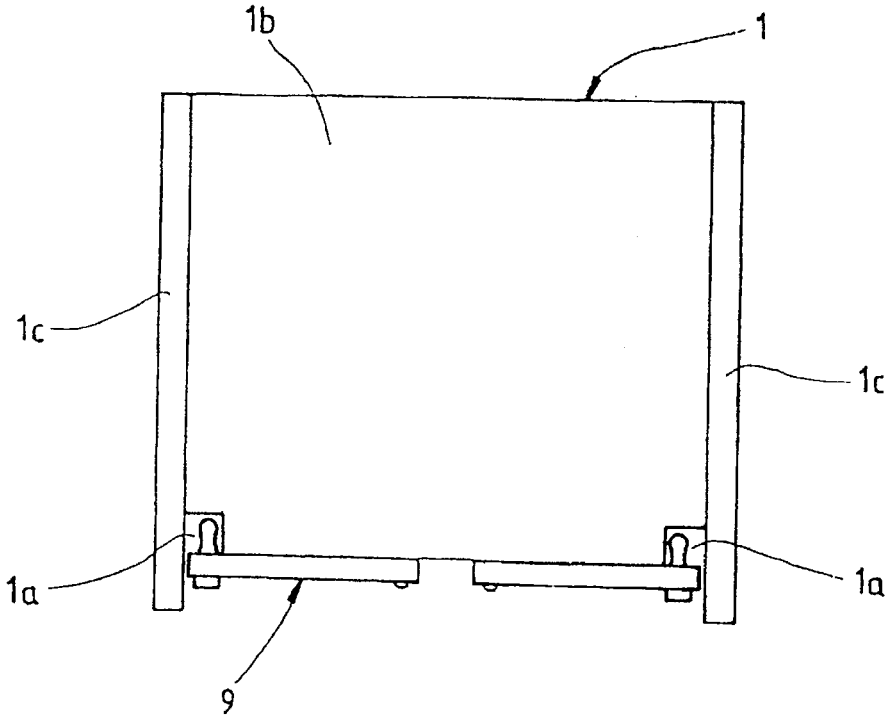
FIG. 3 is a front view of the present book holder.

Referring to FIG. 1 to FIG. 3, there is shown the present book holder comprising a contact plate which is in contact with a book (1) for supporting the book, a supporting rod (7) of which one end is pivotably secured between "L" shaped brackets (3) via a bolt (4), washers (5) and a nut (6) to support the contact plate (1), a memo plate pivotably secured together with the supporting rod to fix scratch papers or manuscript papers by using an appropriate clamp and, a retaining element (9) to grip the book regardless of the thicknesses of both opened sides thereof, wherein the brackets (3) are fixed to face each other on the rear middle upper side thereof by screw (2) which supports the contact plate (1) at a desired angle.

The contact plate (1) comprises a body (1*b*) having a rectangular shaped cut out portion (1*a*) on both bottom sides and legs (1*c*) that extend over the bottom edge of the body (1*b*) and secured on both sides appropriately for example by a screw. Of course, it may be possible to construct the body (1*b*) and the legs (1*c*) integrally. The book shelves (9*c*) are pivoted toward the center to protrude from a recessed position that is parallel to the bottom end of contact plate (1). A book may then be placed in an open position on book shelves (9*c*). The book shelves are then re-pivoted toward the initial position so that the book is fixed between the protrusions and the contact plate.

The memo plate (8) may tightly contact both outer sides (3*a*) of the bracket (3) fixed to the contact plate (1) so as to reinforce the supporting rod (7). Furthermore, the memo stand (8) comprises a pair of arms (8*a*) and memo plate (8*b*) secured on the arms (8*c*) and arranged perpendicular thereto.

In addition, the respective retaining means (9) comprises a book shelf (9*c*) of which one end is pivotably connected to the bottom end of the body (1*b*) via screw (9*b*) and washer (9*a*), and vertical protrusions (9*d*) to prevent turning over the leaves of a book when they are fitted in the cut out portion (1*a*).

During use, the present book holder is placed on the desk with the supporting rod (7) in contact with the contact plate (1) at a desired angle. The book shelves (9*c*) of the retaining element (9) are spread out from the center of the book holder from an initial position and then are collapsed so as to be parallel with the bottom end of the contact plate (1). Thereafter, the reader may put a book on the pair of book shelves (9*c*) and open the book. Subsequently, as the book shelves (9*c*) are pivoted toward the respective legs (1*c*), the book is fixed regardless the thickness of both opened sides via the vertical protrusions (9*d*).

Figure 4:
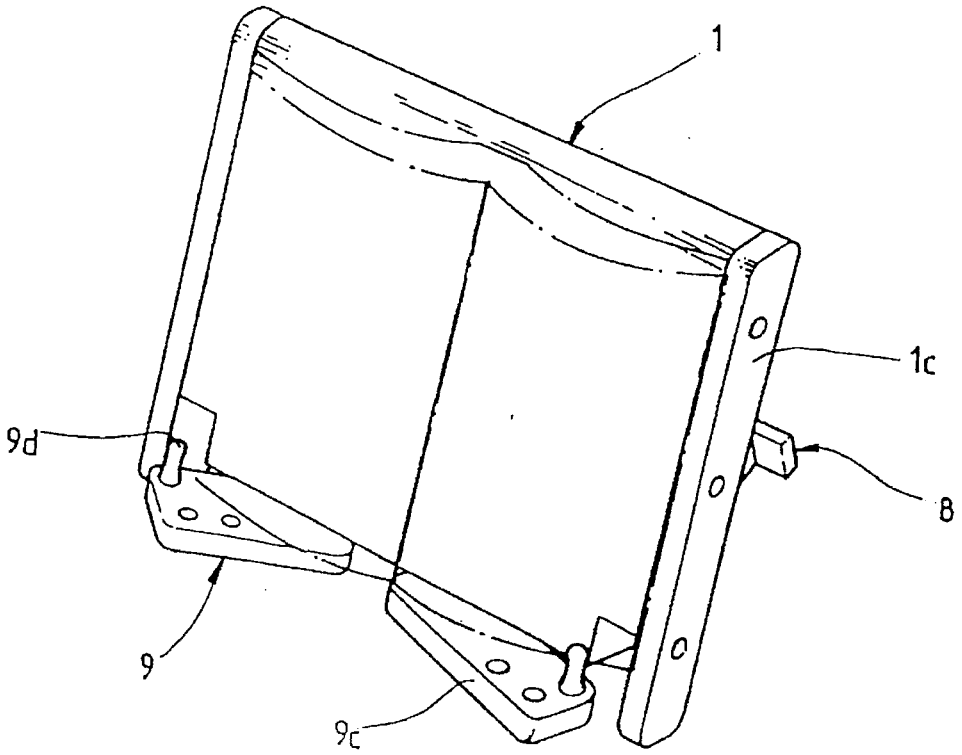
FIG. 4 is a perspective view illustrating a memo plate used to control an inclination angle instead of a supporting rod.
Figure 5:
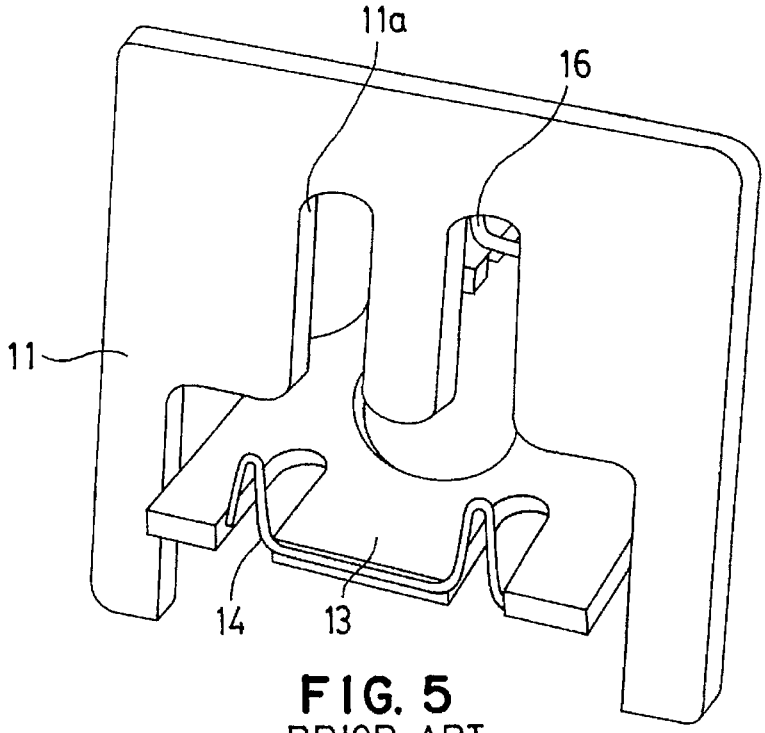
FIG. 5 PRIOR ART
FIG. 5 is a perspective view showing a conventional book holder in use and, FIG. 6 is a bottom plan view in collapsed state of the book holder shown in FIG. 5.
Figure 6:
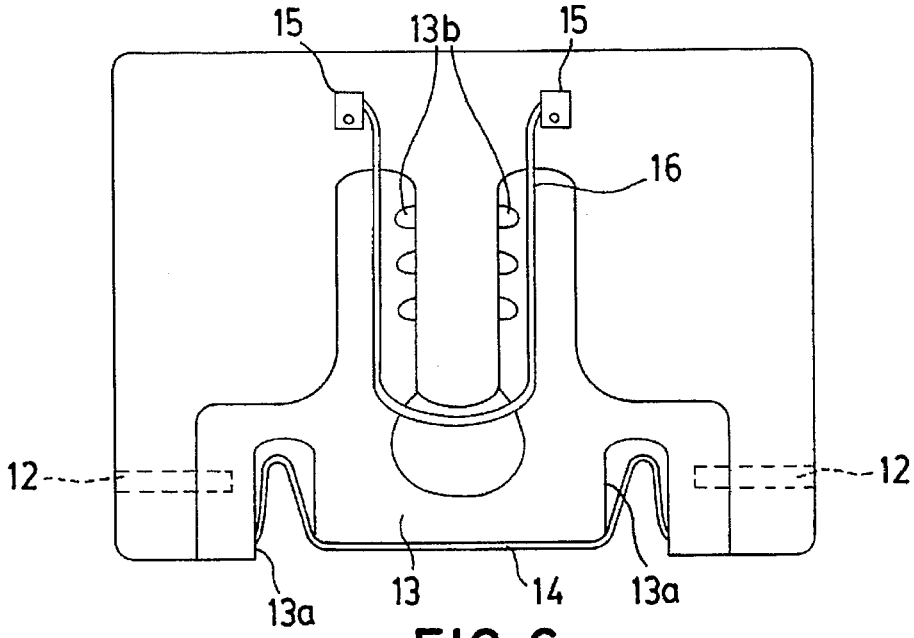
FIG. 6 PRIOR ART

The memo plate of the memo stand (8) may be pivoted to the upper side of the contact plate (1) so as to fix scratch papers or manuscript papers, for example via tweezers. Furthermore, the memo stand (8) also may be used as the supporting rod, as shown in FIG. 4. This position more preferable when the contact plate needs to have a relatively large inclination angle in a small space.

Therefore, according to the present invention a reader may reliably retain a book without regard to its thicknesses via the supporting rod (7) and the memo stand (8).

I claim:

1. A book holder comprising a contact plate (1) for supporting a book, a supporting rod (7) to support the contact plate at a desired angle, wherein one end of the rod is pivotably coupled between a pair of "L" shaped brackets coupled to the rear side of the contact plate, a memo stand (8) pivotably coupled to the supporting rod (7) to fix by clamping means script papers or manuscript papers to the memo stand for viewing from the front side of the contact plate, and two retaining means (9) for securing the respective sides of the opened book.

2. The book holder of claim 1, wherein the memo stand (8) comprises a pair of arms (8*a*) pivotally coupled to the supporting rod and adjacent to the pair of "L" brackets, and a memo plate (8*b*) coupled to the arms.

3. The book holder of claim 1, wherein the retaining means (9) comprises a book shelf (9*c*) of which one end is pivotably connected to the bottom end of the contact plate and wherein the second end of the book shelf includes a protruding member extending substantially perpendicularly from the shelf to prevent turning over of the leaves of the book when the leaves are adjacent to the second end of the book shelf.

4. The book holder of claim 1, further comprising a pair of leg portions coupled to the contact plate and extending over the bottom edge of the body of the contact plate.

5. A book holder comprising:

a contact plate for supporting a book;

a pair of "L" shaped brackets coupled to the rear side of the contact plate;

a supporting rod pivotably coupled between the pair of "L" shaped brackets to support the contact plate at a desired angle;

a memo stand pivotably coupled to the supporting rod, the memo stand including a pair of arms pivotally coupled to the supporting rod and adjacent to the pair of "L" brackets, and a memo plate coupled perpendicularly to the arms; and a pair of retaining means for securing the book.

6. A book holder comprising:

a contact plate for supporting a book;

a pair of "L" shaped brackets coupled to the rear side of the contact plate;

a supporting rod pivotably coupled between the pair of "L" shaped brackets to support the contact plate at a desired angle;

a memo stand pivotably coupled to the supporting rod to fix script papers or manuscript papers to the memo stand by using appropriate clamping means; and retaining means for securing the book, the retaining means including a book shelf wherein one end of the book shelf is pivotably coupled to the bottom end of the contact plate and wherein the second end of the book shelf includes a protruding member extending substantially perpendicularly from the shelf to prevent turning over the leaves of the book when the leaves are adjacent to the second end of the book shelf.

* * * * *